US008065820B2

(12) United States Patent
Sartor et al.

(10) Patent No.: US 8,065,820 B2
(45) Date of Patent: Nov. 29, 2011

(54) SKI BOOT, IN PARTICULAR FOR SKI MOUNTAINEERING

(75) Inventors: Mario Sartor, Volpago Del Montello (IT); Piero Fenato, Caerano di San Marco (IT)

(73) Assignee: OBER ALP S.p.A., Bolzano (IT)

( * ) Notice: Subject to any disclaimer, the term of this patent is extended or adjusted under 35 U.S.C. 154(b) by 437 days.

(21) Appl. No.: 12/453,019

(22) Filed: Apr. 28, 2009

(65) Prior Publication Data

US 2009/0277046 A1 Nov. 12, 2009

(30) Foreign Application Priority Data

May 8, 2008 (IT) ..... VE2008A0039
Nov. 12, 2008 (IT) ..... VE20080027 U

(51) Int. Cl.
*A43B 5/00* (2006.01)

(52) U.S. Cl. ..... 36/50.5; 36/117.1; 36/118.2

(58) Field of Classification Search ..... 36/117.1, 36/118.2, 118.7, 118.8, 118.9, 50.5
See application file for complete search history.

(56) References Cited

U.S. PATENT DOCUMENTS 4,541,147 A * 9/1985 Olivieri ..... 24/68 SK
4,682,426 A * 7/1987 De Marchi ..... 36/50.5
4,790,081 A * 12/1988 Benoit et al. ..... 36/118.9
4,951,402 A * 8/1990 Benoit et al. ..... 36/50.5
5,005,303 A * 4/1991 Bonaventure et al. ..... 36/118.7
5,134,792 A * 8/1992 Balbinot et al. ..... 36/118.1
5,136,794 A * 8/1992 Stampacchia et al. ..... 36/118.7
5,381,612 A * 1/1995 Paris ..... 36/117.9
5,485,688 A * 1/1996 Gorza et al. ..... 36/118.2
5,526,587 A 6/1996 Sarrtor
5,608,976 A 3/1997 Marega et al.
5,845,371 A * 12/1998 Chen ..... 24/71 SK
5,875,566 A 3/1999 Bourdeau et al.
5,875,570 A 3/1999 Sartor
6,247,252 B1 6/2001 Parisotto
6,536,138 B1 * 3/2003 Miralles ..... 36/50.1
6,708,425 B2 3/2004 Parisotto
7,963,050 B2 * 6/2011 Sartor et al. ..... 36/118.7
7,984,571 B2 * 7/2011 Pellegrini ..... 36/117.1

* cited by examiner

*Primary Examiner* — Marie Patterson
(74) *Attorney, Agent, or Firm* — Themis Law

(57) ABSTRACT

A ski boot, designed for ski mountaineering, includes a rigid shell and sole, an inshoe of soft material, and a leg portion pivotally secured to the shell. A lever is located on one side of the leg portion for operating a traction cable located on the other side of the leg portion. The remote end of the traction cable is engaged with, or secured to, a retention element on the leg portion. A spoiler is pivotally mounted at the rear of the shell, and is interposed between the rear of the leg portion and the rear of the inshoe. A lug, or similar coupling element, is formed on the lever. The lever is mounted for pivotal movement in the horizontal direction, between an opened, and closed, configuration or condition. When the lever is in its closed configuration, the lug engages the leg portion and the spoiler, and blocks their pivotal movement, or articulation, relative to the shell.

13 Claims, 9 Drawing Sheets

SKI BOOT, IN PARTICULAR FOR SKI MOUNTAINEERING

FIELD OF THE INVENTION

The present invention relates to a ski boot, in particular for ski mountaineering.

BACKGROUND OF THE INVENTION

Ski boots are known comprising an outer shell of plastic material, a sole, a leg portion pivotally mounted on the shell at bosses provided at the malleoli, and a plurality of clamping levers for the shell and leg portion to immobilize the skier's let and foot inside the boot.

During descent, ski mountaineering requires the leg portion to be rigidly clamped to the shell, whereas during ascent or walking, the leg portion has to be able to swivel longitudinally about the shell.

For this reason, devices have been proposed consisting of a lever disposed vertically on the rear of the leg portion and provided with a traction element which acts simultaneously as a device for closing the leg portion and for clamping the leg portion, or shank, to the shell.

U.S. Pat. No. 6,247,252, granted Jun. 19, 2001, to David Parisotto, discloses a telemark ski boot including a shell of plastic material and an inner sole. The shell is provided with a pair of parallel walls, and a flexible portion extends transversely to the shell in the metatarsus area. Leg piece 4 is joined to the shell by hinge 13. A control device, indicated generally by reference numeral 14, and including blade 15 and control lever 16 adjusts the inclination of the leg piece, or shank, with respect to the shell. The control device is located at the rear 20 of the ski boot, above the heel.

U.S. Pat. No. 6,708,425, granted Mar. 23, 2004, to David Parisotto, discloses a ski boot, particularly a ski-mountaineering or telemark boot. The boot comprises a shell made of plastic, a shank or leg piece hinged to the shell at the ankle, and a control mechanism 14 located at the rear portion of the boot for controlling the tilt of the shank relative to the boot. Lever 20 is hinged to a rear projection 24, and is movable between a work position which prevents rearward motion of the shank, and a release position. A ring 25, hinged to the lever, engages a recess 28 formed in the rear projection of the shell to prevent forward rotation of the shank with respect to the shell.

However, rear mounted, lever operated devices present certain drawbacks, in particular:

- difficult to operate due to its position;
- substantial bulk, requiring the construction of very tall leg portions which are difficult to adapt to small sizes or to women's boots, given the shape of their calves; and
- susceptibility to damage by accidental impact with steps or rocks, thereby losing its operability.

SUMMARY OF THE INVENTION

These drawbacks are eliminated according to the invention by a ski boot, particularly for ski mountaineering, comprising a rigid shell including a sole, an inshoe, a leg portion pivotally mounted on the shell, the leg portion including a first and a second side, and a lever on one side for operating a traction cable engaging a retention element on the other side, and a spoiler member pivotally mounted at the rear of the shell and interposed between the rear of the leg portion and the rear of the inshoe. The lever cooperates with a coupling element, which simultaneously engages the leg portion and the spoiler member to block their articulation, when the lever is moved to its closed position.

BRIEF DESCRIPTION OF THE DRAWINGS

A preferred embodiment of the present invention and an alternative embodiment thereof are further described with reference to the accompanying drawings, in which.

DETAILED DESCRIPTION OF THE INVENTION

Figure 1:
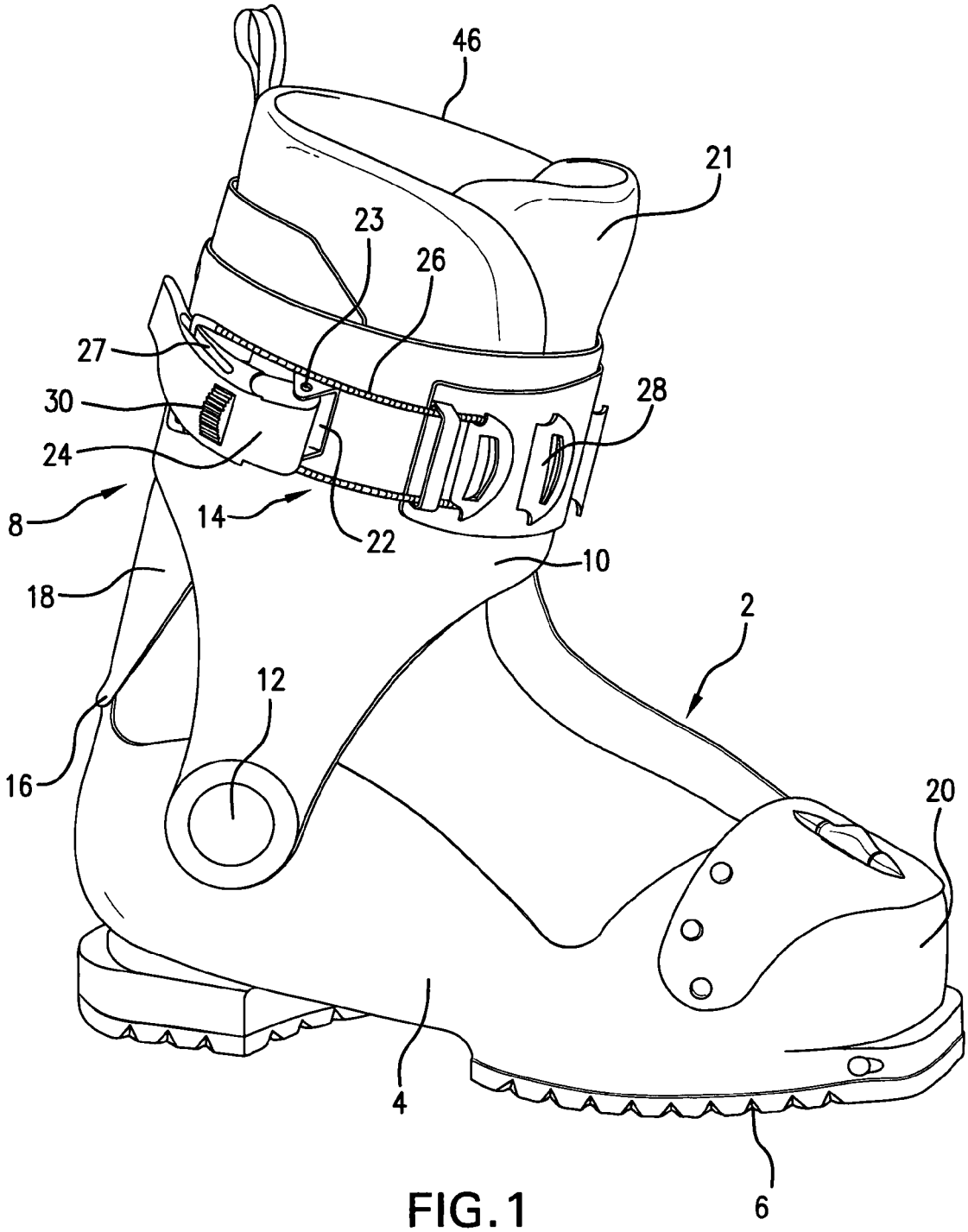
FIG. 1 is a perspective view of a ski boot according to the invention.
Figure 2:
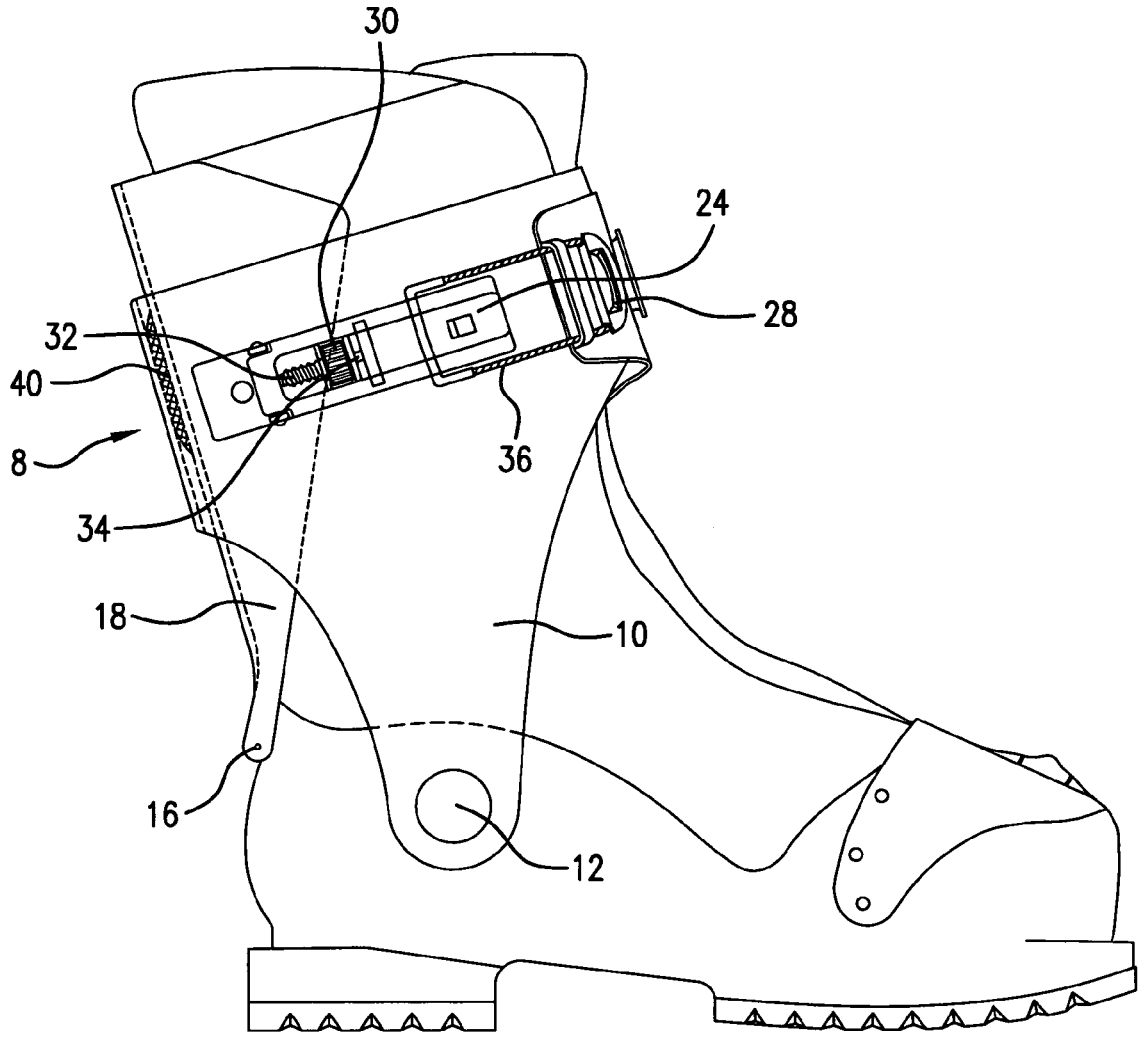
FIG. 2 is a side view thereon with a leg portion in the leg-open configuration.
Figure 3:
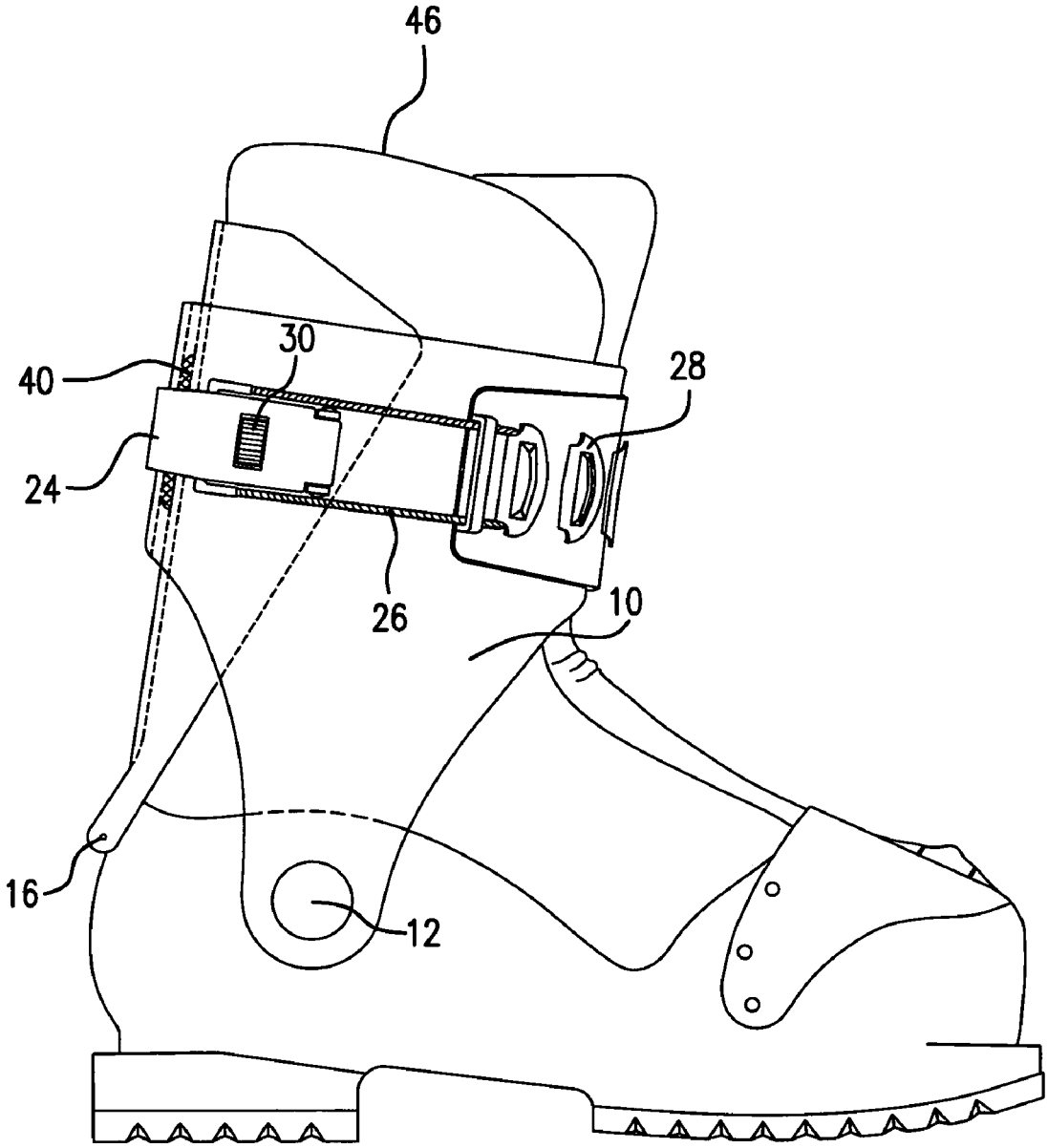
FIG. 3 shows the leg portion clamped to the shell in the leg-closed configuration.

As can be seen from the drawings, the ski boot of the invention is indicated generally by 2, and can be either a ski mountaineering boot or a telemark ski boot.

The boot 2 comprises a shell 4 formed of plastic, composite or metal material, a sole 6, and a leg portion 8, also formed of plastic, composite or metal material, has two vertical flanges 10 pivoted to the shell at bosses 12 provided at the malleoli, and a horizontal strap 14.

A conventional padded inshoe 46 is housed in the shell.

A hinge 16 is provided at the rear of shell 4 for pivotally mounting spoiler 18, interposed between the shell 4 and the leg portion 8. The shell consists of a toe portion 20 and a pair of side walls forming a longitudinal aperture closed by a tongue 21.

Figure 5:
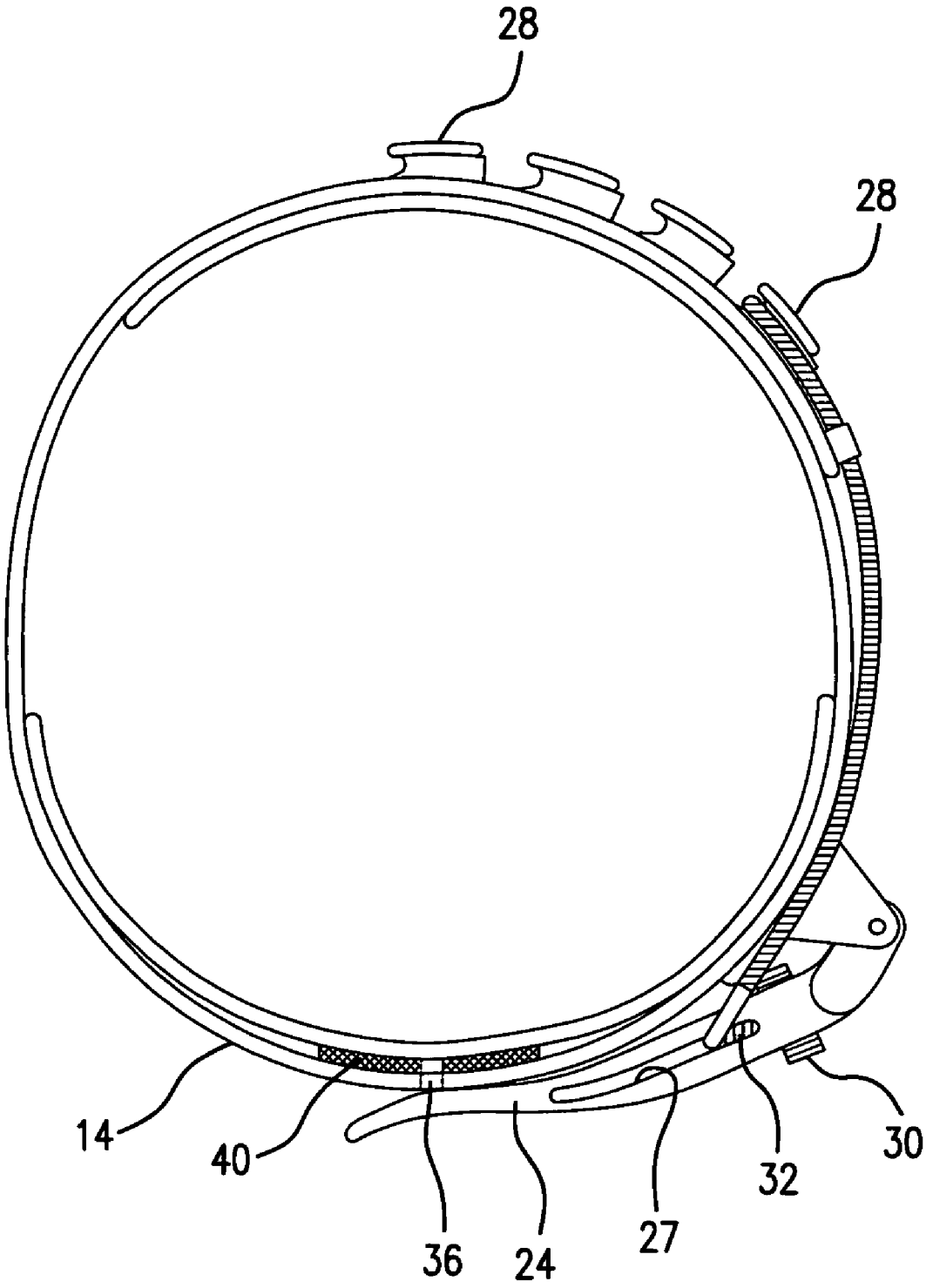
FIG. 5 is a horizontal cross-section through the leg portion in the configuration of FIG. 3.

Bracket 22 is fixed to the strap 14. Pin 23 passes vertically through the arms of the bracket to secure traction on traction lever 24 within the bracket. One end of traction cable 26 is retained within slot 27 in lever 24, as shown in FIGS. 1 and 5. The other end of traction cable 26 is selectively engaged with one of the coupling elements 28.

Figure 6:
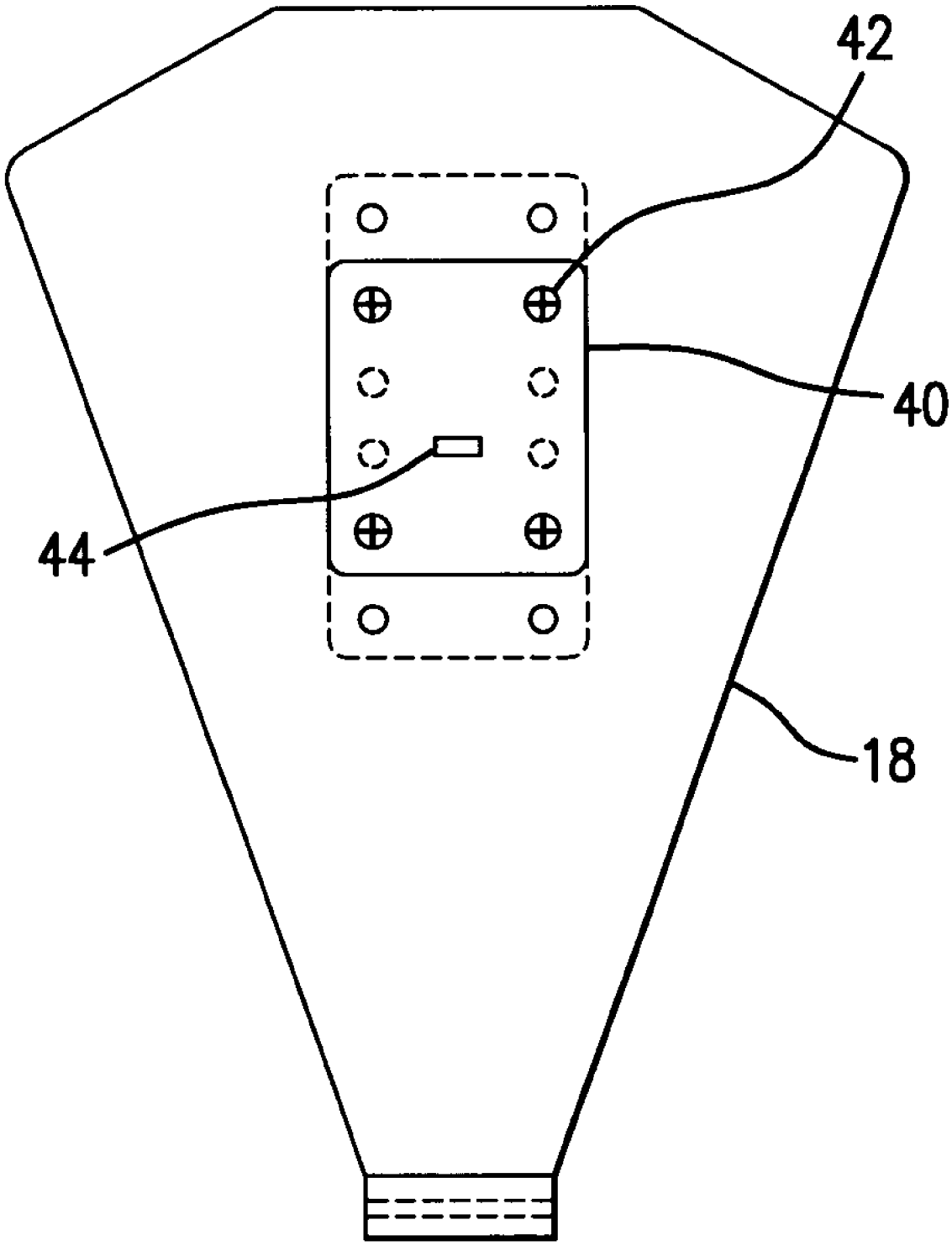
FIG. 6 is a rear view of the spoiler.

Mounted within an aperture provided in the lever arm there is a freely rotatable, but axially blocked, knurled wheel 30 threaded internally for engagement by a screw 32, as shown in FIGS. 1, 5 and 6. The head 34 of screw 32 is shaped to form a transmission element for one end of the traction cable 26.

At its free end the lever 24 presents a substantially cylindrical appendix 36 which, when in the lever-closed configuration, engages in a corresponding aperture 38 provided in the rear part of the strap 14.

A plate is applied to the outer rear surface of spoiler 18. Screws 42 are secured selectively, within apertures 43 to vertically adjust plate 40 relative to spoiler 18. A seat 44 is positioned to face the aperture 38 provided in the strap 14.

Figure 4:
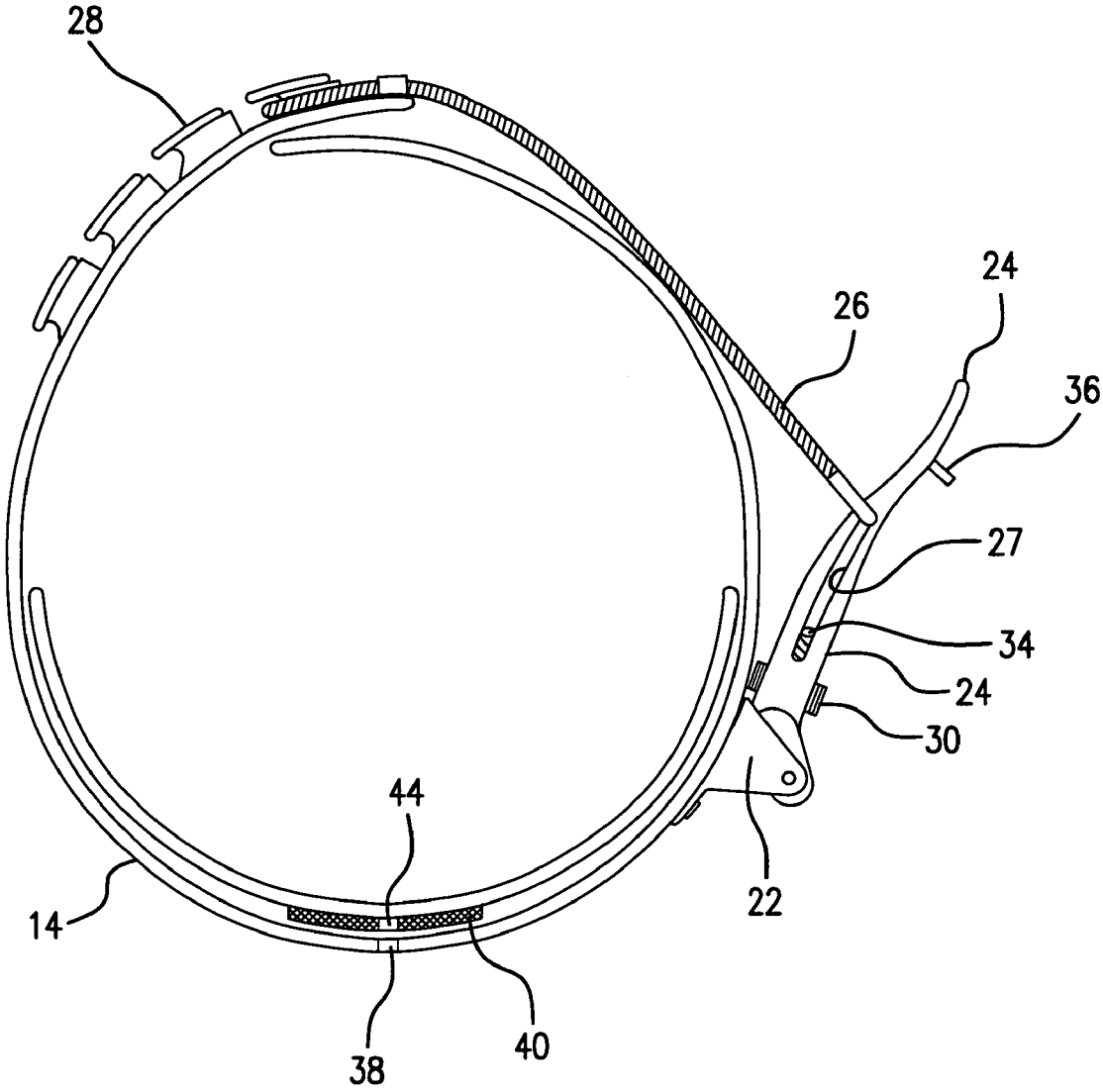
FIG. 4 is a horizontal cross-section through the leg portion in the configuration of FIG. 2.

The ski boot of the invention is used in the following manner:

Initially, the foot of the skier is inserted into the boot, and the skier rotates lever 24 in the anticlockwise, or counterclockwise, direction (with reference to FIG. 4) to release any force on the traction cable 26, which operation enables the two parts of the strap 14 to be maintained spaced apart.

After his, or her, foot has been inserted into the boot, the skier uses the boot in this configuration, to confront ascending and flat surfaces, for the skier is able to apply forward and rearward flexure because of the free pivoting of the leg portion 8 about the shell 4, and of the spoiler 18 about the shell 4.

When the skier has to confront descending surfaces, the lever 24 is rotated clockwise to bring it into contact with the outer surface of the horizontal strap 14 (see FIG. 5).

As soon as the traction cable 26 moves beyond the dead point formed by the pivot pin 23 for lever 24 and bracket 22, the lever 24 remains stable in this configuration. Then, the skier, by making transverse movements of the foot, inserts the appendix 36 on lever 24 into the hole 38. Then, by swivelling the boot in the longitudinal plane, the lever inserts the appendix 36 into the seat 44 of the plate 40 as soon as this faces the hole 38, thereby obtaining the desired result of clamping of the leg portion to the spoiler 18 and consequently to the shell.

When the skier has again to confront an ascending slope or a plane, the lever is operated in the anticlockwise, or counterclockwise, direction to disengage the appendix 36 from the seat 44 and hole 38, thereby allowing the spoiler 18 and leg portion 8 to rotate freely and to reduce the clamping effect exerted by the leg portion.

Figure 7:
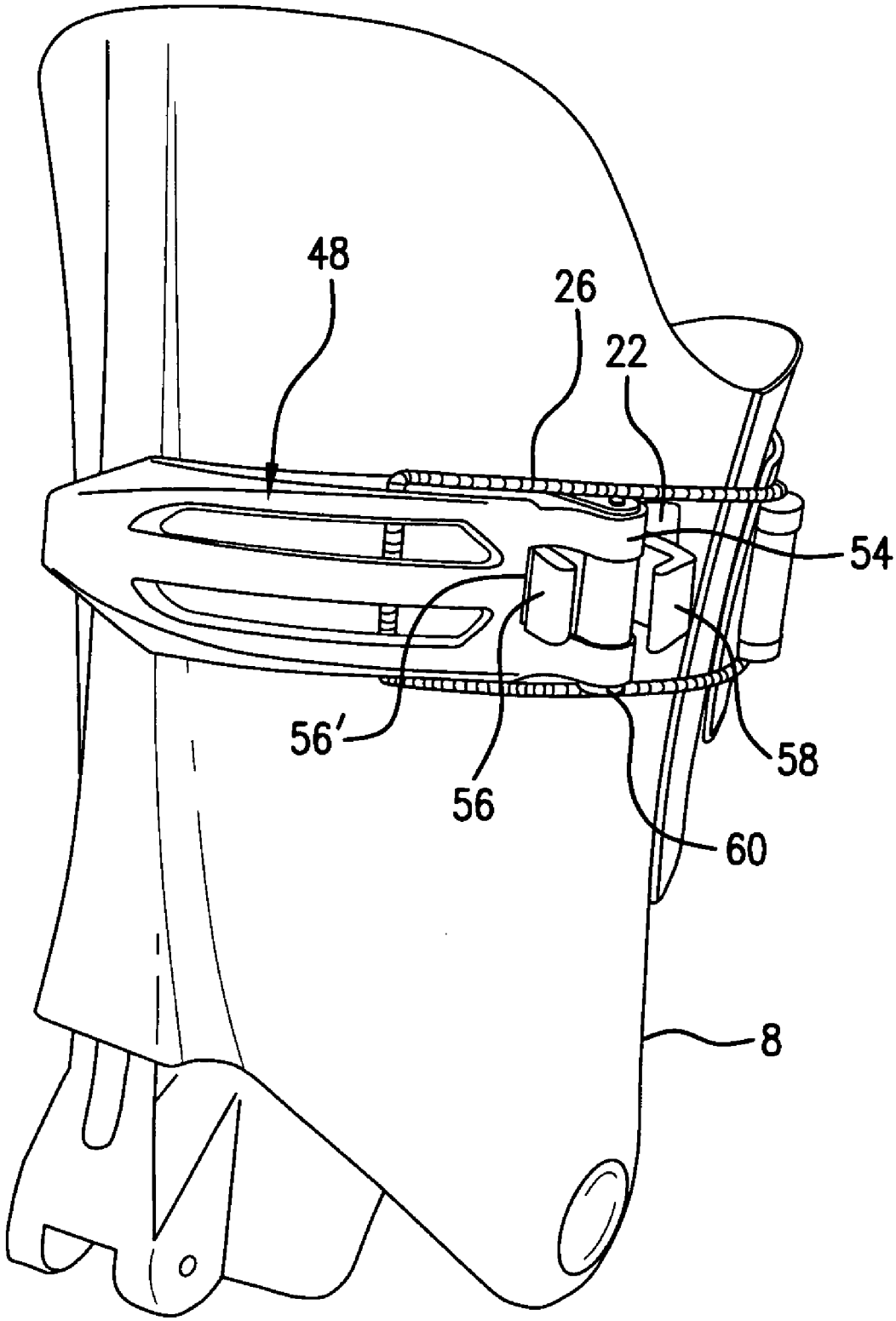
FIG. 7 is a rear perspective view of an alternative lever closure mechanism applied to the ski boot, shown in the lever-closed configuration.
Figure 8:
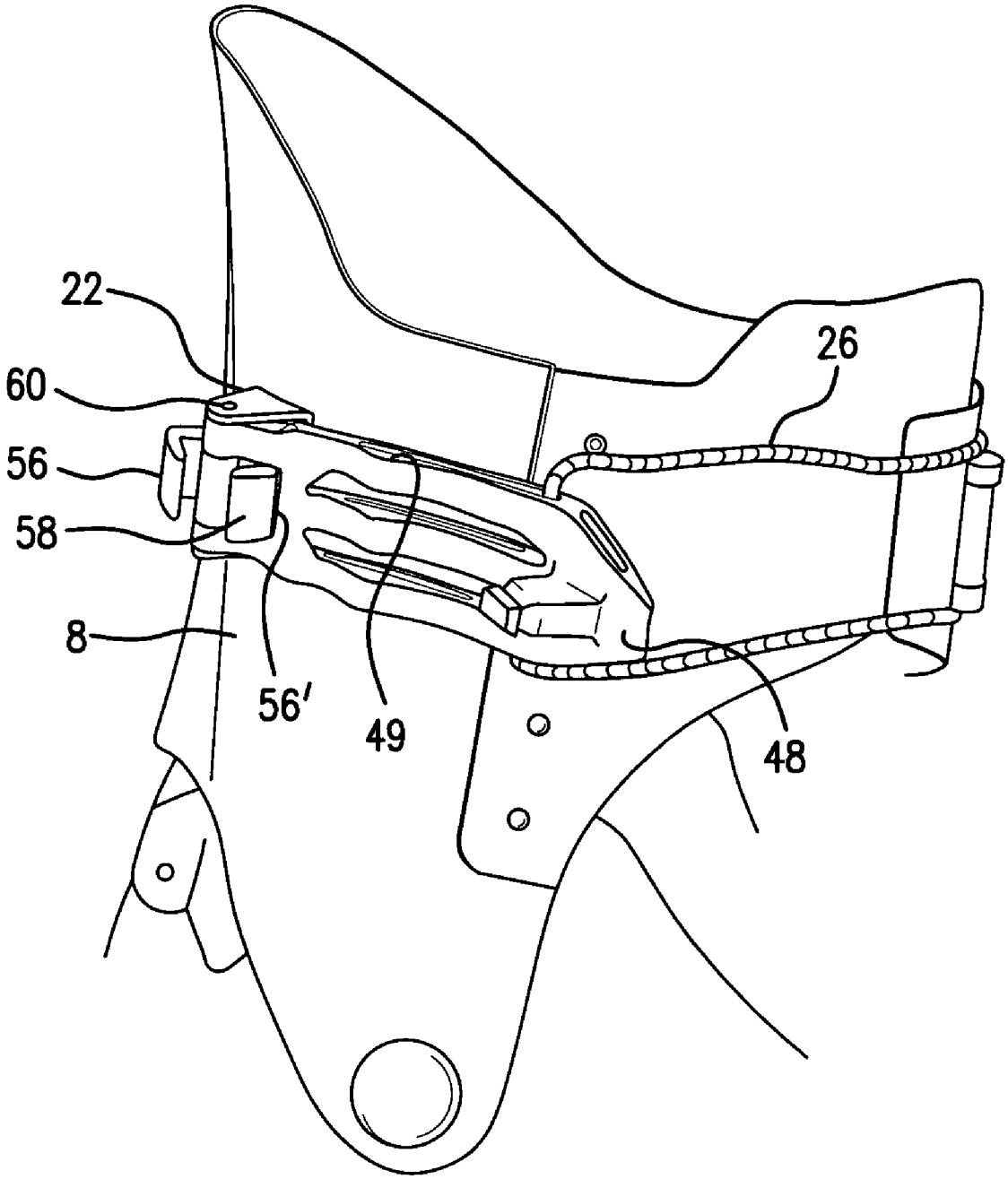
FIG. 8 is a front perspective view of the lever closure mechanism of FIG. 7, with the lever in its open configuration, or position.
Figure 9:
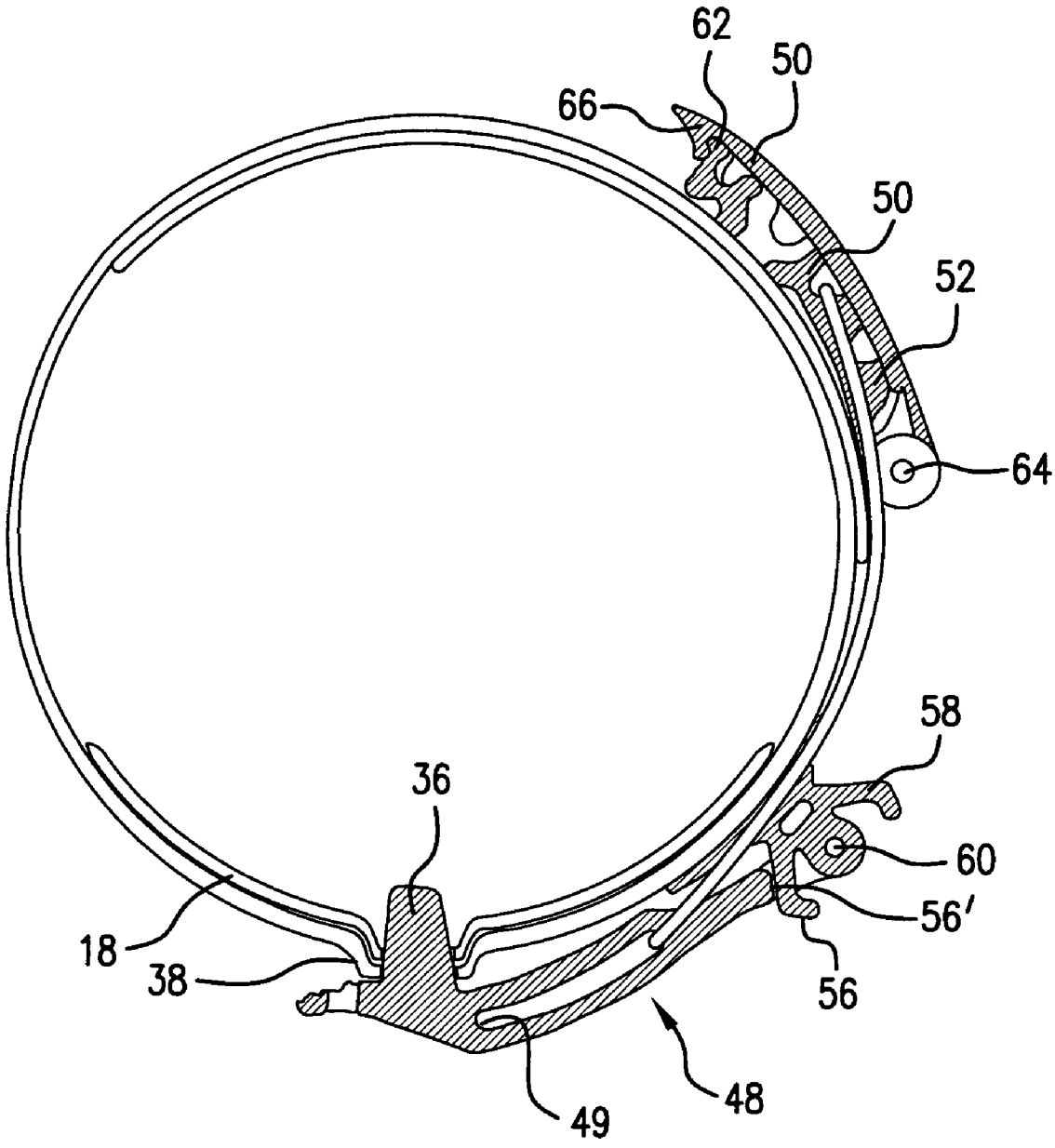
FIG. 9 is a cross-section of the lever closure mechanism of FIG. 7, with the lever in its closed configuration, or position.

FIGS. 7, 8 and 9 show an alternative embodiment of the lever clamping mechanism for a ski boot. Lever 48 includes a longitudinal slot 49. One end of traction cables 26 is housed within slot 49, and the opposite end of traction cable 26 is looped about one of the teeth 50 of a toothed rack 52, that is securely mounted to the other side of leg portion 8, as shown in FIG. 9.

A pin or shaft 60 extends between the arms of bracket or fork 22, and the shaft serves as an axis for pivotal movement of lever 48, and retainer 54.

A retainer 54 is mounted for pivotal movement about pin 60. Retainer 54 includes a pair of spaced, L-shaped arms 56, 58, as shown in FIG. 9. The arms are formed of an elastically yieldable material. Undercuts 56', on the outer surfaces of arms 56, 58, cooperate with the contact surfaces in lever 48 to lock the lever in its opened, and closed, positions.

By engaging undercuts 56' in one or the other of the two arms 58, the lever assumes a stable configuration, both in the closed position and in the open position, thereby avoiding any "flapping" when the traction cable is not engaged between the rack teeth.

The rack 52 is also provided with a cover 62 pivoted to the rack on a pin 64 and provided at its free end with an appendix 66, which removably and elastically, snap-engages an appendix 68 provided on the rack.

In this manner, even with the lever 48 in its opened condition, the traction cable 26 remains engaged in the chosen tooth to prevent having to search for the correct position on subsequent closure.

Various other refinements and modifications may occur to the skilled artisan. Consequently, the appended claims should be construed in a manner consistent with the inventive thrust of the inventor's contribution to ski boots, and should not be limited to the specific terms.

What is claimed is:

1. A ski boot, in particular for ski mountaineering, comprising:

a) a rigid shell with a sole, b) an inshoe, of soft material, retained within said shell, c) a leg portion mounted on said shell for pivotal movement relative thereto, d) said leg portion having two sides, e) a lever secured to one side and mounted for pivotal movement between an opened and closed position;

f) a retention element provided on the other side of said leg portion, g) a traction cable extending horizontally about said leg portion, h) one end of said cable secured about said retention element and the other end of said cable joined to said lever, i) a member pivotably mounted upon the rear of said shell and interposed between the rear of said leg portion and the rear of said inshoe, and j) a coupling element defined on said lever, k) whereby, when said lever is moved to its closed position, said coupling element simultaneously engages said leg portion and said member, thereby blocking their articulation.

2. A ski boot as claimed in claim 1, wherein said member is a boot spoiler.

3. A ski boot as claimed in claim 2, wherein said lever coupling element is a substantially cylindrical appendix.

4. A ski boot as claimed in claim 3, wherein said lever coupling element engages in a seat provided in the spoiler.

5. A ski boot as claimed in claim 3, wherein said lever coupling element also engages a hole provided in said leg portion.

6. A ski boot as claimed in claim 2, further comprising a vertically adjustable plate applied to said spoiler, and provided with a seat for engagement by said coupling element of the lever.

7. A ski boot as claimed in claim 1, wherein said lever is provided with members for adjusting the degree of traction intensity.

8. A ski boot as claimed in claim 1, further comprising blocking means for preventing rotation of said lever when in the open configuration substantially resting against said shell.

9. A ski boot as claimed in claim 8, further comprising blocking means for preventing the rotation of said lever when in the closed configuration with one end of the cable secured about said retention element.

10. A ski boot as claimed in claim 8, wherein said blocking means consist of a retainer with arms which are rigid with a bracket for pivoting the lever and which interact with said lever.

11. A ski boot as claimed in claim 10, wherein said arms are L-shaped.

12. A ski boot as claimed in claim 1, wherein said retention element consists of a rack of teeth provided with a cover.

13. A ski boot as claimed in claim 12, wherein said cover is pivoted to one end of said rack.

* * * * *